US010039331B2

(12) United States Patent
Vauge-Lalanne et al.

(10) Patent No.: US 10,039,331 B2
(45) Date of Patent: Aug. 7, 2018

(54) CLOTHING FOR DOWNHILL SKIING

(71) Applicant: SKIS ROSSIGNOL, Saint-Jean de Moirans (FR)

(72) Inventors: Magali Vauge-Lalanne, Courchevel Village (FR); Florent Lassalle, Saint Cassien (FR); Jason McLaren, Singapore (SG)

(73) Assignee: SKIS ROSSIGNOL, Saint-Jean De Moirans (FR)

( * ) Notice: Subject to any disclaimer, the term of this patent is extended or adjusted under 35 U.S.C. 154(b) by 0 days.

(21) Appl. No.: 14/803,292

(22) Filed: Jul. 20, 2015

(65) Prior Publication Data

US 2016/0021942 A1 Jan. 28, 2016

(30) Foreign Application Priority Data

Jul. 22, 2014 (FR) ..... 14 57061

(51) Int. Cl.
*A41D 1/082* (2018.01)
*A41D 13/015* (2006.01)
(Continued)

(52) U.S. Cl.
CPC ..... *A41D 1/082* (2013.01); *A41D 13/0015* (2013.01)

(58) Field of Classification Search
CPC ..... A41D 13/00; A41D 1/082; A41D 1/08; A41D 1/06; A41D 17/02; A41D 13/0543; A41B 11/00
(Continued)

(56) References Cited

U.S. PATENT DOCUMENTS 4,862,523 A * 9/1989 Lipov ..... A41B 11/14 2/409
6,231,488 B1 * 5/2001 Dicker ..... A41D 13/0015 2/69
(Continued)

FOREIGN PATENT DOCUMENTS

EP 1673991 A2 6/2006
EP 1844669 A1 * 10/2007 ..... A41D 13/0015
(Continued)

OTHER PUBLICATIONS

French Search Report and Written Opinion issued in French Appl. No. 1457061 dated Mar. 19, 2015.

*Primary Examiner* — Jameson Collier
*Assistant Examiner* — Heather Mangine
(74) *Attorney, Agent, or Firm* — Marshall, Gerstein & Borun LLP

(57) ABSTRACT

Clothing for practicing downhill skiing which covers the lower part of the torso and the lower limbs and which includes various zones made using textile fabrics with different elasticities, characterized in that it includes two bands of the first type, presenting lower elasticity than the rest of the clothing, extending from the inner part of the thigh and passing above the anterior part of the thigh, approximately at the level of the iliac crests, and up to the area in the proximity of the lower lumbar vertebrae, both bands are symmetrical in relation to the median plane of the clothing, and two bands of a second type, which are even less flexible, which extend downwards from the top of the anterior zone of the thigh, passing over the antero-external part of the thigh.

12 Claims, 2 Drawing Sheets

(51) Int. Cl.
*A41B 9/00* (2006.01)
*A41D 13/00* (2006.01)

(58) Field of Classification Search
USPC ..... 2/401, 242, 227, 239, 240, 69
See application file for complete search history.

(56) References Cited

U.S. PATENT DOCUMENTS

D460,602 S * 7/2002 Tanaka ..... D2/742
D465,900 S * 11/2002 Tanaka ..... D2/742
D507,857 S * 8/2005 Ota ..... D2/742
D513,831 S * 1/2006 Ota ..... D2/731
7,730,552 B2 * 6/2010 Ota ..... A41D 13/0015 2/227
8,286,262 B2 * 10/2012 Rance ..... A41D 7/00 2/67
8,296,864 B2 * 10/2012 Torry ..... A41D 1/08 2/69
D681,916 S * 5/2013 Tanaka ..... D2/738
9,144,252 B1 * 9/2015 Kostrzewski ..... A41D 1/08
2003/0101506 A1 6/2003 Fujii et al.
2004/0255358 A1 * 12/2004 Ota ..... A41D 13/0015 2/69
2006/0169004 A1 * 8/2006 Belluye ..... A41D 1/084 66/177
2008/0141431 A1 * 6/2008 Rance ..... A41D 7/00 2/67
2012/0100778 A1 * 4/2012 Cho ..... A41D 1/06 450/95
2013/0111646 A1 5/2013 Sevenants
2013/0160189 A1 * 6/2013 Yang ..... A63B 21/0552 2/227

FOREIGN PATENT DOCUMENTS

EP 1844669 A1 10/2007
WO WO-2012/114209 A1 8/2012

* cited by examiner

CLOTHING FOR DOWNHILL SKIING

CROSS-REFERENCE TO RELATED APPLICATIONS

This application claims the benefit of priority under 35 U.S.C. § 119 of French patent application no. 1457061, filed Jul. 22, 2014, the entire content of which is hereby incorporated herein by reference, in its entirety and for all purposes.

TECHNOLOGICAL FIELD

The present disclosure relates to a type of athletic wear, in particular clothing for downhill skiing, and more specifically competitive downhill skiing. To be more particular, it is a form-fitting or nearly form-fitting type of clothing, intended to cover the lower limbs and designed to optimize muscular performance.

BACKGROUND

Generally, the practice of the sport can be improved in certain aspects by using appropriate clothing.

Thus, it is common knowledge that muscular effectiveness can be increased by using clothing which includes zones that provide specific compression for the muscles that they cover. Examples of such clothing are described in documents US 2013/0111646 and WO 2012/114209.

The clothing described in these documents has the advantage of putting the muscles in a state of pre-stress, which limits the risk of injuries, particularly those caused by rapid elongation of the muscles. However, when practicing downhill skiing and in particular competitive downhill skiing, the skier's position is such that his knees are folded at an extreme angle, which corresponds to a highly specific configuration for which the clothing described in the above mentioned documents does not provide any particular advantage.

SUMMARY

There is thus a specific requirement for clothing that provides pre-stress for practicing downhill skiing and particularly competitive skiing.

Thus, the Applicant has designed a type of clothing for practicing downhill skiing which covers the lower part of the torso and the lower limbs and which includes various zones made of textiles with different elasticities.

This type of clothing is characterized in that it includes a pair of bands of the first type with a lower level of elasticity. Both these first type of bands extend from the interior of a thigh and pass above the anterior part of the thigh, approximately at the level of the iliac crests, and up to the area in the proximity of the lower lumbar vertebrae. These bands are symmetrical in relation to the median plane of the clothing.

In other words, the disclosed embodiments involve the creation of a piece of clothing which includes a special zone where the elasticity is lowest, thus ensuring compression, and which has a specific geometry. To be precise, this zone begins on the anterior surface of the thigh and extends straight upwards, partially covering the sartorius muscle. This zone then extends along the external surface of the thigh, above the iliac crests, and then envelopes the pelvis up to the lumbar region. In a first form of embodiment, these bands do not reach the spinal column, but are separated by a region of stronger elasticity. In another form of embodiment, both bands can connect at the spinal column and form a continuous band following a symmetrical configuration from one thigh to the other.

Thus, during the specific movements that are observed in downhill skiing in which the legs are highly bent, and the torso is inclined towards the front, this characteristic zone comprised of two bands of the first type is placed under stress, and thus exerts a high level of pressure on certain muscles of the thigh, particularly the Sartorius muscle, as well as the gluteus medius and multifidus muscle in the lumbo-pelvic area.

This additional applied pressure improves proprioception, as well as the balance between the stresses observed in the lumbo-pelvic area and in the thighs, when the skier is in his or her characteristic position. These bands also limit the lateral rotary movements of the thigh muscles.

To ensure the full effectiveness of this low elasticity zone, in particular during the flexion of the knees, this band of the first type may extend to above the knee. In a particular stance, it can bend below the kneecap. Similarly, the effectiveness can be improved via a configuration for this band of the first type in which the aforesaid band is wider at its ends, near the lumbar vertebrae zone, so as to distribute the stress in this region during the flexion of the torso.

In an advantageous method of execution, the clothing may also include bands of a second type, which are even less flexible, which extends downwards from the top of the anterior zone of the thigh, passing over the antero-external part of the thigh. Thus, this band of the second type covers the external part of the quadriceps, which is subject to more intense stress when the skier experiences vibrations or impacts due to the trajectory on surfaces that are not perfectly flat. To be more precise, this band of the second type may pass straight from the vastus lateralis muscle and thus reduce the balancing movements of this muscle; this results in the improvement of balance and control in the legs during the curves in the track. This band of the second type may extend below the kneecap, where it may join the band of the first type on the same thigh in a particular form of execution. Advantageously in practice, this band of the second type can start at the top straight from the upper part of the sartorius muscle on which the band of the first type already passes. The zone marked by these bands of the first and second type at the level of the thigh encircles and assures the compression of the rectus femoris muscle which acts to extend the knee and bend the thigh, during the repeated phase of repetitive curves that occurs when the skier is moving on the snow.

In practice, the compression effect exercised by the characteristic bands is measured by a differential pressure of at least 25% compared to the more elastic zones of the clothing. This pressure at the characteristic bands is measured at between 12 and 15 mm Hg, while the pressure exercised in the other regions of higher elasticity is rather lower at 8 mm Hg. The different parts of the fabric can be juxtaposed with each other by sticking or sewing. It is also possible to attach characteristic bands in superposition on a more elastic piece of clothing that covers the entirety of the thighs and the pelvic region.

The textiles used are more elongated in the warp direction than the weft direction, in order to preferably allow elongation of the clothing width-wise more than its elongation length-wise.

BRIEF DESCRIPTION OF THE FIGURES

The presently disclosed embodiments, as well as the resulting advantages, shall be made clear through the following description of the method of manufacturing the fabric, as well as through the figures.

DETAILED DESCRIPTION

Figure 1:
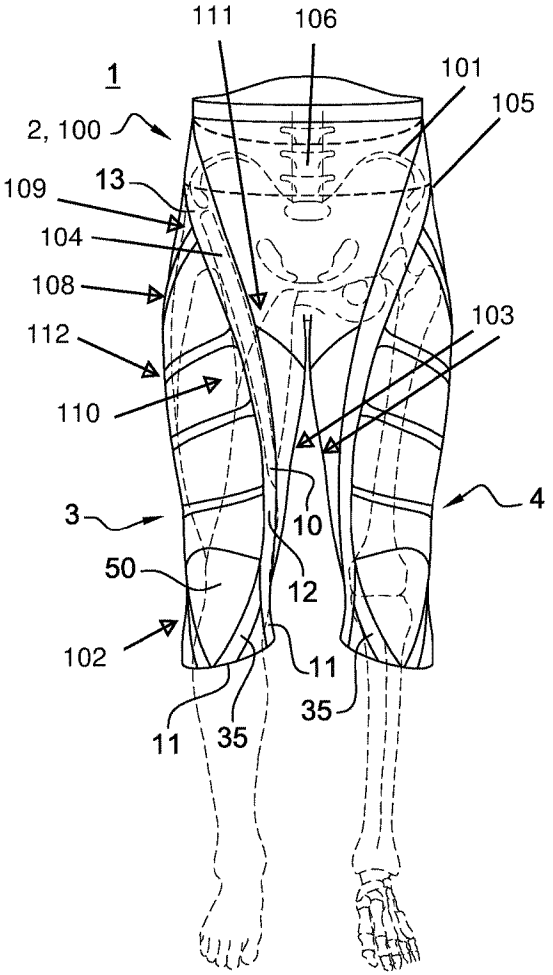
FIG. 1 is a frontal view of the clothing in accordance with the disclosure.

As shown in FIG. 1, the clothing 1, in accordance with the disclosed embodiments resembles is skin-tight and has a first region (2) covering the lower part of the torso 100 or the pelvis 101. This region (2) extends towards the lower side through both legs 3 and 4, covering the thigh up to below the knee 102.

Naturally, the clothing can extend to the lower part of the legs. Insofar as this region does not directly concern the disclosed embodiments, it will not be described in detail. It may also extend upwards, covering the chest, and include braces if required.

The clothing is made by assembling parts and allows the body of the skier to be effectively covered.

In accordance with the presently described embodiments, the clothing includes bands (10) and (20) which present a lower level of elasticity than the rest of the clothing. To be precise, the different textiles used for the clothing can be polyamide-based or in particular Nylon®- and spandex-based, with a global mass of, for example 200 g/m2 which has a lower proportion of spandex, typically around half, for the least elastic textile. For example, the least elastic textile may consist of 18% spandex for 82% polyamide, while the most elastic textile may have 30% spandex and 70% polyamide.

The elasticity measurements carried out on the least flexible textile, in accordance with the standard UNI EN 14704-1, resulted in elongation at 3.6 kg force between 85 and 115%, typically 100% in the transversal direction. The elongation at a force of 3.6 kg means a value between 51 and 69%, typically 60% in the longitudinal direction. Similarly, the measured shape, at 40% elongation is between 455 and 845 gram-force (gf), and typically in the vicinity of 650 gf in the transversal direction, and between 840 and 1660 gram-force (gf), and typically in the vicinity of 1200 gf in the longitudinal direction.

As regards the most elastic textile, the same tests show transversal elongation between 208 and 282%, typically in the vicinity of 245%, and in the longitudinal direction between 187 and 253%, typically in the vicinity of 220%.

Equivalent tests show a force measured at 40% of elongation in the transversal direction for a value between 210 and 390 gf, approximately 300 gf, and in the longitudinal direction for values between 175 to 325 gf and typically approximately 250 gf.

As shown in FIG. 1, the band of the first type (10) starts below the knee 102, in its internal part, and extends upwards on the inner surface 103 of the thigh. This band then has a first zone (12) which is straight in line with the sartorius muscle 104.

Figure 2:
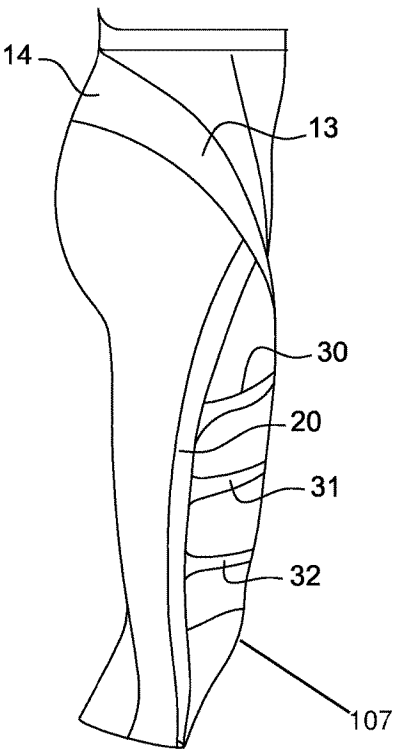
FIG. 2 is a side view of the clothing in FIG. 1.
Figure 3:
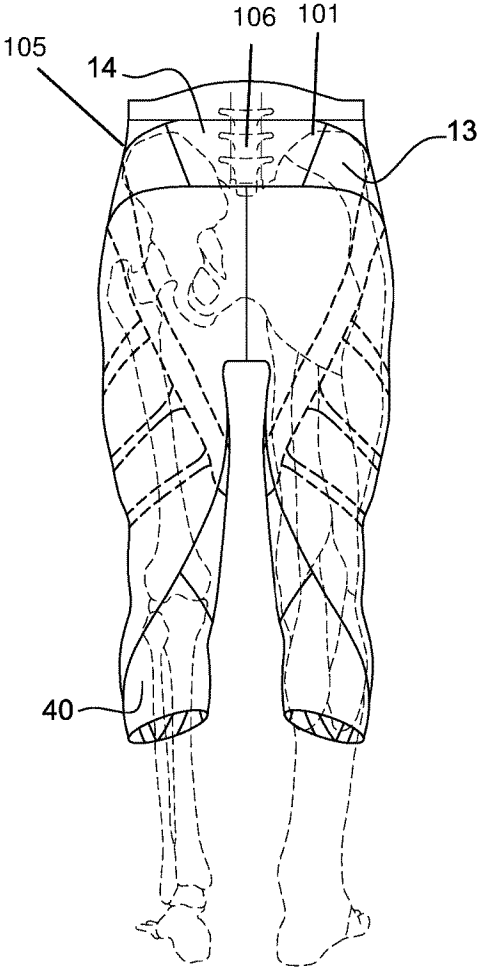
FIG. 3 is a rear view of the same clothing.
Figure 5:
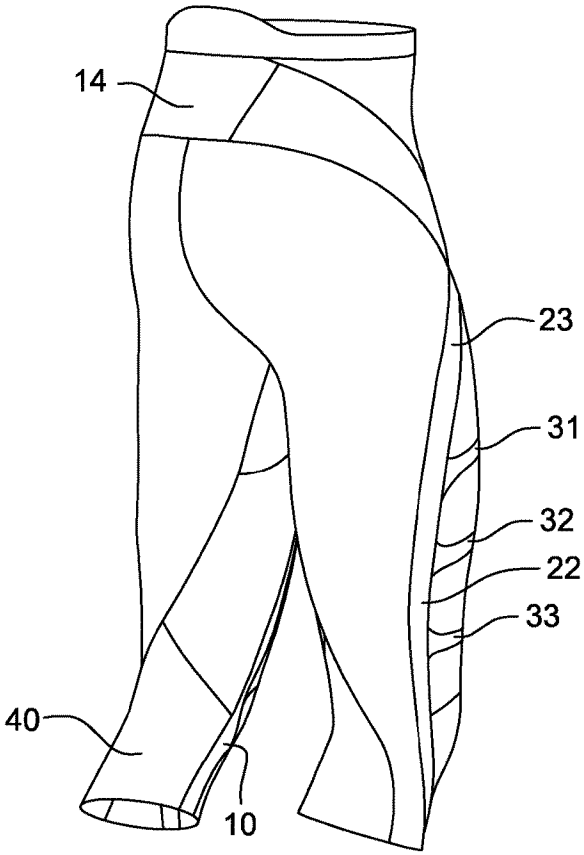
FIG. 5 is a three-quarters rear view of the same clothing.

This band (10) extends upwards and widens; it then passes above an anterior part 110 of the thigh and near the iliac crests 105, as shown in FIG. 2. This band (10) continues to widen towards the rear of the clothing, and stops near the lumbar area. It is connected to a second zone (14) which is more elastic, and advantageously breathable, located in line with the lumbar vertebrae 106.

In a particular method of execution which is not shown here, the path of the band of the first type may then be extended by a symmetrical band and reach the lower part of the opposite knee 102, and thus form a continuous band from one knee to the other.

Figure 4:
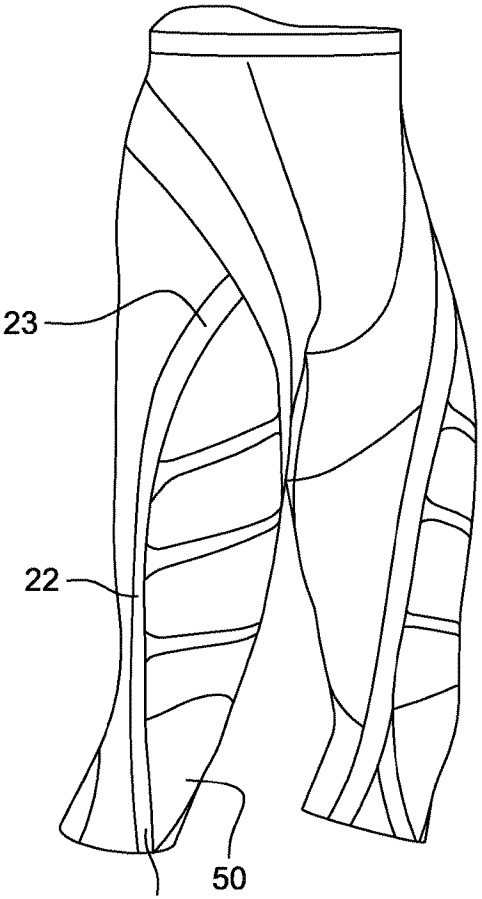
FIG. 4 is a frontal three-quarter view of the same clothing.

Additionally, the clothing also includes a band of the second type (20), which starts, as shown in FIGS. 1 and 4, below the knee 102, preferentially on its external area in a (21) zone where it is connected to a third zone 11 of the band of the first type (10). In a variant, this band may start below the kneecap 107. This second band (20) extends upwards and along the length of certain quadricep muscles—more precisely, the vastus lateralis muscle 108. In the upper part of the thigh, this band curves inside, towards a second zone (23) which is connected to the band of the first type (10) near the upper part of the rectus femoris muscle 109. Stated differently, each second band (20) extends downward from a top 111 of the anterior part 110 of the thigh, and passes over an anterior-external part 112 of the thigh.

Naturally, the two legs of the clothing each have one band of the second type (20). Each of the bands of the second type (20) are arranged entirely on a combination of a front portion and a lateral side portion and connect to the bands of the first type (10) at an intersection located on the front portion at an upper part of the anterior zone of the thigh and are spaced away from the respective lateral side portion. The bands of the second type (20) then curve away from and back toward the front portion. Further the bands of the first type (10) are connected to bands of the second type (20) by at least one third polymer film band (31-33), which is typically polyurethane-based superposed and stuck to the most elastic textile, which allows limiting the transversal spreading between the two bands (10, 20), and thus helps better contain the muscles. A similar band of film (35) can be used to connect the two bands of the first and second type below the knee.

Additionally, the clothing 1 can include additional zones (40) which are made using different textiles and present a higher rate of transition, thus allowing the diffusion of heat in the fold of the knee.

Similarly, the clothing 1 can include a second region (50) covering the kneecap, which can be made using a different part, helping it adjust to the shape of the knee.

As a consequence of the above, the clothing, in accordance with the disclosure, presents multiple advantages, in particular that of containing the thigh muscles, which are heavily used when the skier is in a bent position.

These thigh muscles are joined to the muscles of the lower back and in particular to increase the support to the lumbar area. They help improve the sensation of responsiveness and ensure the rapid contraction of the muscle. This results in better traversing of the curves in the track, and thus an improvement in the skier's performances. Similarly, such support to the muscles allows better recovery from fatigue and limits the risk of muscular injuries.

What is claimed is:

1. Clothing for practicing downhill skiing which is configured to cover a lower part of the torso and lower limbs of a wearer, and which includes various zones made using textile fabrics with different elasticities, wherein the clothing comprises:

a front portion made of a first textile and configured to cover an anterior lower part of the torso and an anterior part of the lower limbs, the front portion including a crotch area configured to cover a crotch of the wearer;

a rear portion made of the first textile and configured to cover a posterior lower part of the torso and a posterior part of the lower limbs;

a pair of medial side portions arranged between the front portion and the rear portion and configured to cover respective inner thigh portions of the wearer;

a pair of lateral side portions arranged between the front portion and the rear portion and configured to cover respective outer thigh portions of the wearer;

a pair of first bands, each of the first bands made of a second textile having a lower elasticity than the first textile, and a first portion of each of the first bands is arranged on the front portion of the clothing and a second portion of each of the first bands is arranged on the rear portion of the clothing such that each of the first bands is configured to extend from the inner thigh portion, pass above an anterior zone of the thigh, proximate to iliac crests, and extend up to a position proximate to a lower lumbar vertebrae, the two first bands configured to be symmetrical in relation to a median plane of the clothing; and a pair of second bands, each of the second bands made of a third textile less flexible than the first textile, and each of the second bands arranged entirely on a combination of the front portion and a respective one of the lateral side portions, with a third portion of each of the second bands arranged on the front portion of the clothing such that each of the second bands is configured to extend downwards from an upper part of the anterior zone of the thigh, over an anterior-external part of the thigh, and below a kneecap, wherein each of the first bands is configured to cover a Sartorius muscle, and wherein the second bands are directly connected to the first bands, respectively, on the front portion of the clothing such that the second bands directly connect to the first bands, respectively, at an intersection configured to be at the upper part of the anterior zone of the thigh, and wherein the intersection of the first bands and the second bands is entirely located on the front portion such that the intersection is spaced away from the respective lateral side portion and each of the second bands ends at a point located on the front portion, and wherein each of the second bands curves away from and back toward the front portion between the intersection of the first and second bands and the point where the second bands end.

2. Clothing in accordance with claim 1, wherein the first bands are configured to extend up to below a knee.

3. Clothing in accordance with claim 1, wherein the first bands are configured to have a first width along the inner thigh portion and a second width at the lumbar vertebrae, the second width being greater than the first width.

4. Clothing in accordance with claim 1, wherein the second bands are configured to cover the vastus lateralis muscle.

5. Clothing in accordance with claim 1, wherein a portion of the second bands is configured to cover an upper part of the Sartorius muscle.

6. Clothing in accordance with claim 1, wherein the second bands are configured to be connected to a respective one of the first bands in a zone below the kneecap.

7. Clothing in accordance with claim 1, wherein the second bands exert a compression pressure that is 25% greater than a compression pressure exerted by the portion made of the first textile.

8. Clothing in accordance with claim 1, wherein the third textile is identical to the second textile.

9. Clothing in accordance with claim 1, wherein a width of each of the first bands increases from a first width to a second width as the first band is configured to extend from the inner thigh portion, pass above the anterior zone of the thigh, and extend up to the lower lumbar vertebrae.

10. Clothing in accordance with claim 1, wherein each of the second bands is configured to pass over an external portion of a Quadriceps muscle.

11. Clothing in accordance with claim 1, further comprising one or more third bands connecting each of the second bands to a respective one of the first bands below the intersection of the first bands and the second bands.

12. Clothing in accordance with claim 11, wherein at least one of the one or more third bands is oriented substantially perpendicular to the respective first band.

* * * * *